US008667932B2

(12) United States Patent
Hamakawa et al.

(10) Patent No.: US 8,667,932 B2
(45) Date of Patent: Mar. 11, 2014

(54) COOLING STRUCTURE FOR INTERNAL COMBUSTION ENGINE

(75) Inventors: Takeru Hamakawa, Wako (JP); Kenji Sato, Wako (JP); Shigeo Okui, Wako (JP); Naoto Kodama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 357 days.

(21) Appl. No.: 12/943,766

(22) Filed: Nov. 10, 2010

(65) Prior Publication Data

US 2011/0114042 A1 May 19, 2011

(30) Foreign Application Priority Data

Nov. 19, 2009 (JP) ..... 2009-264143
Jun. 21, 2010 (JP) ..... 2010-140368

(51) Int. Cl.
*F02F 1/14* (2006.01)
*F01P 1/02* (2006.01)
*F02F 1/10* (2006.01)

(52) U.S. Cl.
USPC ..... 123/41.79; 123/41.67; 123/41.72

(58) Field of Classification Search
USPC ..... 123/41.79
See application file for complete search history.

(56) References Cited

U.S. PATENT DOCUMENTS

| | | | | |
|---|---|---|---|---|
| 7,216,611 | B2 * | 5/2007 | Matsutani et al. | 123/41.72 |
| 2003/0230254 | A1 * | 12/2003 | Matsutani et al. | 123/41.79 |
| 2005/0028758 | A1 * | 2/2005 | Hughes et al. | 123/41.74 |
| 2005/0217614 | A1 * | 10/2005 | Matsutani et al. | 123/41.74 |
| 2008/0060593 | A1 * | 3/2008 | Nakada et al. | 123/41.79 |
| 2009/0031978 | A1 * | 2/2009 | Kobayashi et al. | 123/142.5 R |

FOREIGN PATENT DOCUMENTS

| | | | |
|---|---|---|---|
| EP | 1 167 735 | A2 | 1/2002 |
| JP | 61-3944 | U | 1/1986 |
| JP | 4-30246 | U | 3/1992 |
| JP | 04-259646 | A | 9/1992 |
| JP | 07-332154 | A | 12/1995 |
| JP | 2001-200751 | A | 7/2001 |
| JP | 2002-21632 | A | 1/2002 |
| JP | 2003-074409 | A | 3/2003 |
| JP | 2005-120944 | A | 5/2005 |

(Continued)

OTHER PUBLICATIONS

Chae Dong Suk et al., Water Jacket Spacer, English Language Abstract of KR 2009 0063995 A, Jun. 18, 2009, Korea.

(Continued)

*Primary Examiner* — Rinaldi Rada
*Assistant Examiner* — Syed O Hasan
(74) *Attorney, Agent, or Firm* — Arent Fox LLP

(57) ABSTRACT

A spacer covets intermediate portions of respective cylinder bores in a depth direction of a water jacket throughout the entire peripherics of the intermediate portions in the peripheral direction. Accordingly, the intermediate portion of each cylinder bore becomes higher in temperature than any other portion, and is thermally expanded. Thereby, the clearance between the cylinder bore and the corresponding piston increases. Thus, the friction decreases to improve fuel efficiency of an internal combustion engine. Furthermore, the temperature of oil lubricating the intermediate portion of the cylinder bore rises, and the viscosity decreases. Accordingly, the effect of friction reduction is enhanced more. Furthermore, upper and lower portions of the cylinder bores in a cylinder axis direction are sufficiently cooled. Therefore, the cooling performance of a top part and a skirt part of each piston, which tends to become higher in tempera lure, is secured. Accordingly, overheat can be prevented.

6 Claims, 12 Drawing Sheets

(56) References Cited

FOREIGN PATENT DOCUMENTS

| | | | |
|---|---|---|---|
| JP | 2005-273469 | A | 10/2005 |
| JP | 2007-138891 | A | 6/2007 |
| JP | 2008-64054 | A | 3/2008 |
| JP | 2008-208744 | A | 9/2008 |
| JP | 2009-243414 | A | 10/2009 |
| KR | 10-2009 0063995 | A | 6/2009 |
| KR | 2009 0063995 | A | 6/2009 |
| WO | WO 2008/010584 | | 1/2008 |

OTHER PUBLICATIONS

Dr. M. Herzog, Amendment in European Application No. 10190417.5, Apr. 18, 2011, Europe.

J. Matray, European Patent Office Communication in EP 10190417.5, May 13, 2011, Europe.

J. Matray, European Patent Office Communication in EP 10190417.5, Sep. 9, 2011, Europe.

Dr. H.-J. Trossin, Amendment in EP 10190417.5, Jan. 13, 2012, Europe.

J. Matray, European Patent Office Communication in EP 10190417.5, Mar. 28, 2012, Europe.

Dr.-Ing. H.-J. Trossin, Amendment in EP 10190417.5, Aug. 7, 2012, Europe.

J. Matray, European Patent Office Communication in EP 10190417.5. Nov. 26, 2012, Europe.

Japanese Office Action, Japanese Patent Application No. 2010-140368 dated Sep. 11, 2013.

* cited by examiner

COOLING STRUCTURE FOR INTERNAL COMBUSTION ENGINE

BACKGROUND OF THE INVENTION

1. Field of the Invention

The present invention relates to a cooling structure for an internal combustion engine in which: a spacer is fitted inside a water jacket formed to surround a periphery of a cylinder bore of a cylinder block in the internal combustion engine; and a cooling condition of the cylinder bore is controlled by regulating a flow of cooling water in the water jacket by use of the spacer.

2. Description of the Related Art

Japanese Patent Application Laid-open No. 2005-273469 has made publicly known such a cooling structure for an internal combustion engine in which: assuming that the space formed between the internal peripheral surface of the spacer and the inner wall surface of the water jacket is divided into an upper region, an intermediate region and a lower region in a cylinder axis line direction, the spaces in the upper region and the lower region are set larger than the space in the intermediate region; and thereby, the cylinder bores are cooled uniformly in the cylinder axis line direction.

Meanwhile, such a spacer is fitted inside the water jacket, and regulates the flow of the cooling water, hence controlling the cooling condition of the cylinder bores. Thereby, the spacer exerts an effect of reducing friction between each piston and the corresponding cylinder bore. In this regulation, however, if the spacer excessively restricts the flow of the cooling water in the upper and lower portions of the water jacket in the cylinder axis line direction, heat may be insufficiently dissipated from the upper and lower portions of each piston to the cylinder bore, and seizure of the piston and the like may occur. Particularly, the upper portion of each piston is in contact with the cylinder bore with its piston ring interposed in between. For this reason, the performance of heat dissipation from the upper portion of each piston to the cylinder bore needs to be secured.

SUMMARY OF THE INVENTION

The present invention has been made in view of the foregoing situation. An object of the present invention is to secure the performance of heat dissipation from an upper portion of a piston to a cylinder bore while maintaining the spacer's effect of reducing friction between the piston and the cylinder bore.

In order to achieve the object, according to a first feature of the present invention, there is provided a cooling structure for an internal combustion engine in which: a spacer is fitted inside a water jacket formed to surround a periphery of a cylinder bore of a cylinder block in the internal combustion engine; and a cooling condition of the cylinder bore is controlled by regulating a flow of cooling water in the water jacket by use of the spacer, wherein the spacer covers, entirely in a peripheral direction, an intermediate portion of the cylinder bore in a depth direction of the water jacket.

According to the above-described configuration, the spacer is fitted inside the water jacket formed to surround the periphery of the cylinder bore of the cylinder block in the internal combustion engine. For this reason, the cylinder bore is thermally insulated by regulating the flow of the cooling water in the water jacket by use of the spacer. Thereby, the friction between the cylinder bore and a piston can be reduced by thermally expanding the cylinder bore.

The spacer covers the intermediate portion of the cylinder bore in the depth direction of the water jacket throughout the entire periphery of the intermediate portion in the peripheral direction. For this reason, the intermediate portion of the cylinder bore becomes higher in temperature than any other portion, and is thermally expanded. Thereby, the clearance between the cylinder bore and the piston increases. Particularly, when a large side thrust is applied to the piston during a compression process and an expansion process, the friction between the piston and the cylinder bore decreases. This can contribute to improving fuel efficiency. In addition, because the intermediate portion of the cylinder bore becomes higher in temperature than any other portion, the temperature of oil lubricating such a portion rises, and the viscosity decreases. Accordingly, the effect of friction reduction is enhanced more.

Furthermore, the upper and lower portions of the water jacket in the depth direction, where the cooling water can flow without obstruction from the spacer, are sufficiently cooled. For this reason, the cooling performance of the top part and skirt part of the piston, which tend to become higher in temperature, is secured. Accordingly, overheat can be prevented.

According to a second feature of the present invention, in addition to the first feature, the spacer is arranged closer to an inner wall surface of the water jacket than to an outer wall surface of the water jacket.

According to the above-described configuration, the spacer is arranged closer to the inner wall surface of the water jacket than to the outer wall surface of the water jacket. For this reason, the cooling water is made less likely to contact the inner wall surface of the water jacket, which faces the cylinder bore, then the effect of thermally insulating the cylinder bore is enhanced, and the diameter of the cylinder bore is enlarged. Accordingly, the friction between the cylinder bore and the piston can be reduced effectively.

According to a third feature of the present invention, in addition to the first or second feature, the spacer comprises: a spacer main body part for covering the cylinder bore entirely in the peripheral direction; and a lower support leg extending from the spacer main body part in a cylinder axis direction, and having one end abutting against a bottom portion of the water jacket, and the lower support leg is formed to have a smaller thickness in a radial direction than the spacer main body part.

According to the above-described configuration, the spacer includes: the spacer main body part for covering the cylinder bore throughout the entire periphery of the cylinder bore in the peripheral direction; and the lower support leg extending from the spacer main body part in the cylinder axis direction, one end of the lower support leg abutting against the bottom portion of the water jacket. Once the spacer is fitted inside the water jacket, the contact of the lower end portion of the lower support leg with the bottom portion of the water jacket makes it possible to position the spacer in the up-and-down direction. Moreover, because the lower support leg is formed in such a way that the thickness of the lower support leg is thinner in the radial direction than the thickness of the spacer main body part, the influence of the lower support leg on the flow of the cooling water in the water jacket can be minimized.

According to a fourth feature of the present invention, there is provided a cooling structure for an internal combustion engine in which: a spacer is fitted inside a water jacket formed to surround a periphery of a cylinder bore of a cylinder block in the internal combustion engine; and a cooling condition of the cylinder bore is controlled by regulating a flow of cooling water in the water jacket by use of the spacer, wherein when a piston slidably fitted in the cylinder bore is situated in a maximum side-pressure generating position, an upper edge of the spacer is situated between a piston ring and a skirt part of the piston.

According to the above-described configuration, the spacer is fitted inside the water jacket formed to surround the periphery of the cylinder bore of the cylinder block in the internal combustion engine. For this reason, the cylinder bore is thermally insulated by regulating the flow of the cooling water in the water jacket by use of the spacer. Thereby, the friction between the cylinder bore and a piston can be reduced by thermally expanding the cylinder bore. When the piston is situated in the maximum side-pressure generating position, the upper edge of the spacer is situated between the piston ring and the skirt part of the piston, respectively. For this reason, the heat dissipation performance of an upper portion of the piston can be secured by: reducing the sliding resistance as a result of enlarging the diameter of the cylinder bore by covering a portion of the cylinder bore, which corresponds to the outer side of the skirt part in the radial direction, by use of the spacer; and concurrently avoiding the coverage of the outside of the piston ring in the radial direction by use of the spacer.

According to a fifth feature of the present invention, in addition to the fourth feature, when the piston is situated in a bottom dead center, a lower edge of the spacer is situated above the piston ring.

According to the above-configuration, the lower edge of the spacer is situated above the piston ring when: the piston is situated in the bottom dead center; and the quantity of heat dissipated from the piston to the cylinder bore increases due to decrease in the movement speed of the piston. For this reason, the heat dissipation performance can be secured by avoiding the spacer's inhibition of the dissipation of heat from the pistons to the cylinder bore through the piston ring.

According to a sixth feature of the present invention, in addition to the fourth or fifth feature, the spacer is arranged along an inner wall surface of the water jacket.

According to the above-described configuration, the spacer is arranged along the inner wall surface of the water jacket. For this reason, the cooling water is made less likely to contact the inner wall surface of the water jacket, which faces the cylinder bore, then the effect of thermally insulating the cylinder bore is enhanced, and the diameter of the cylinder bore is enlarged. Accordingly, the friction between the cylinder bore and the piston can be reduced effectively.

Here, note that a top ring 19, a second ring 20 and an oil ring 21 of an embodiment correspond to the piston ring of the present invention.

The above description, other objects, characteristics and advantages of the present invention will be clear from detailed descriptions which will be provided for the preferred embodiment referring to the attached drawings.

BRIEF DESCRIPTION OF THE DRAWINGS

FIGS. 1 to 12C show an embodiment of the present invention:

FIG. 1 is a perspective view of a cylinder block of an internal combustion engine with four cylinders mounted in a straight line;

FIG. 2 is a perspective view of a spacer;

FIG. 3 is a view seen from a direction of an arrow 3 in FIG. 1;

FIG. 4 is a view seen from a direction of an arrow 4 in FIG. 3;

FIG. 5 is a sectional view taken along a line 5-5 in FIG. 3;

FIG. 6 is an enlarged view of a part indicated by an arrow 6 in FIG. 5;

FIG. 7 is a sectional view taken along a line 7-7 in FIG. 3;

FIG. 8 is a sectional view taken along a line 8-8 in FIG. 3;

FIG. 9 is a sectional view taken along a line 9-9 in FIG. 3;

FIG. 10 is a sectional view taken along a line 10-10 in FIG. 3;

FIG. 12C is a sectional view taken along a line C-C in FIG. 12B.

DETAILED DESCRIPTION

Descriptions will be hereinbelow provided for an embodiment of the present invention on the basis of FIGS. 1 to 12.

Figure 1:
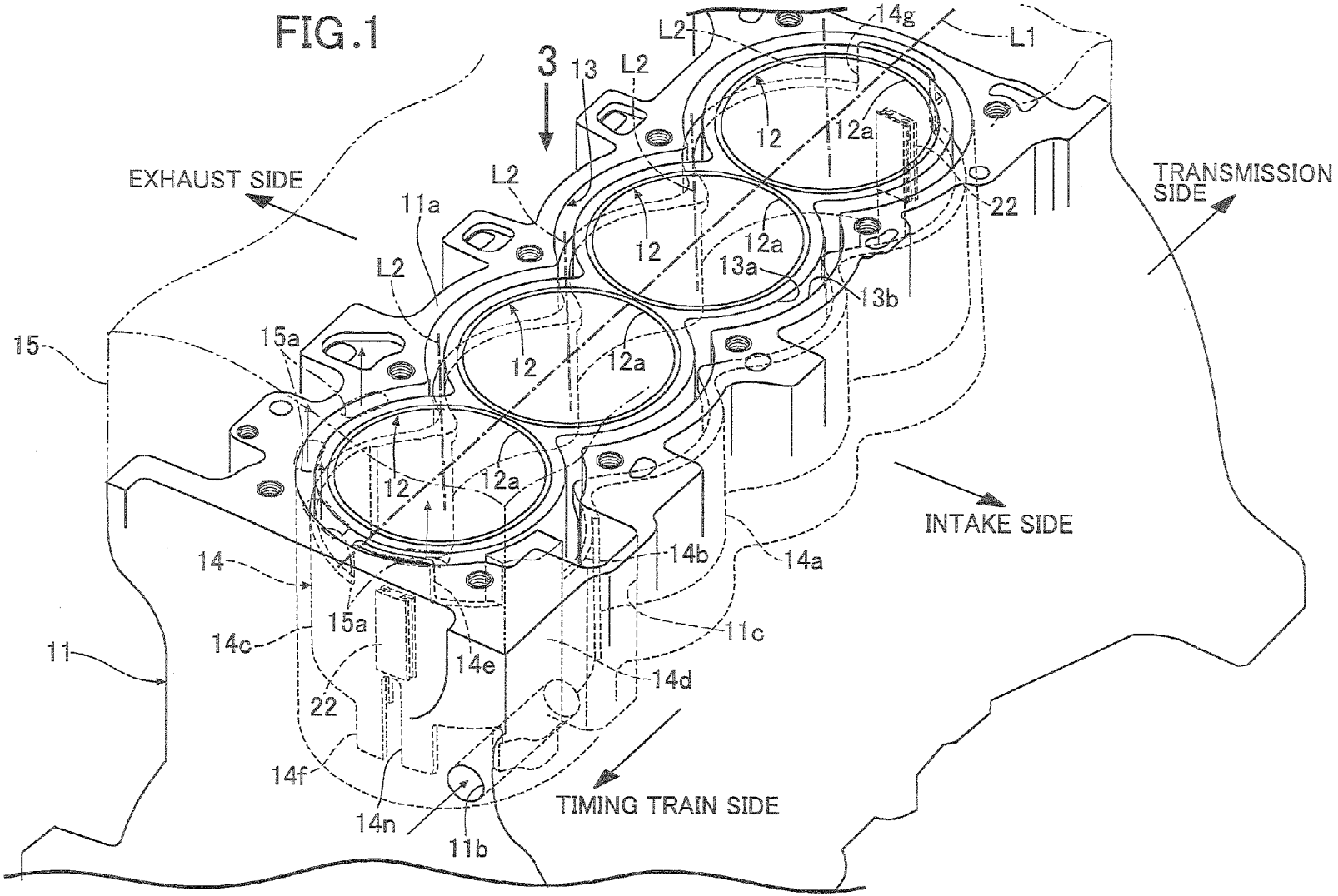

As shown in FIG. 1, four cylinder sleeves 12 are embedded along a cylinder row line L1 in a cylinder block 11 of an internal combustion engine with four cylinders mounted in a straight line. A water jacket 13 is formed to surround the outer peripheral surfaces of the respective cylinder sleeves 12. The cylinder block 11 according to this embodiment is of a Siamese type, and no portion of the water jacket 13 is formed between each neighboring two of the cylinder sleeves 12. Thereby, the shortening of the dimension of the internal combustion engine in the cylinder row line L1 direction is achieved. The water jacket 13 opened in a deck surface 11*a* of the cylinder block 11 extends downward from the deck surface 11*a* toward a crankcase up to a certain depth. A spacer 14 made of a synthetic resin is arranged in an interstice between an inner wall surface 13*a* and an outer wall surface 13*b* of the water jacket 13. The spacer 14 is inserted in the interstice therebetween from the opening in the deck surface 11*a* of the cylinder block 11.

Note that with regard to an "up-and-down direction" in this description, the cylinder head side in a cylinder axis line L2 direction is defined as "upper," and the crankcase side in the cylinder axis line L2 direction is defined as "lower."

As clear from FIGS. 1 to 5, the spacer 14 includes a spacer main body part 14*a*, a cooling water inlet port part 14*b* and a cooling water outlet port part 14*c*. The entire peripheries of four cylinder bores 12*a* in the cylinder bock 11 are surrounded by the spacer main body part 14*a*, the cooling water inlet port part 14*b* and the cooling water outlet port part 14*c*. The cooling water inlet port part 14*b* surrounds an intake-side portion of one cylinder bore 12*a* which is situated on a first end side in the cylinder row line L1 direction (on a timing train side). The cooling water outlet port part 14*c* surround the first end-side portion of the cylinder bore 12*a* in the cylinder row line L1 direction and an exhaust side-portion of the cylinder bore 12*a*. A partition wall 14*d* is integrally provided in a position which is slightly offset from the first end-side portion of the spacer 14 in the cylinder row line L1 direction to the intake-side portion of the space 14, and which intervenes between the cooling water inlet port part 14*b* and the cooling water outlet port part 14*c*. The partition wall 14*d* is formed thicker than the spacer main body part 14*a*, and projects upward from the upper edges of the cooling water inlet port part 14*b* and the cooling water outlet port part 14*c*, and downward from the lower edges of the cooling water inlet port part 14*b* and the cooling water outlet port part 14*c*.

Inside the water jacket 13, an upper cooling water passage 13*c* surrounding the peripheries of the respective four cylinder bores 12*a* is formed between the upper edge of the spacer main body part 14*a* and an undersurface of a cylinder head 15. In addition, a lower cooling water passage 13*d* surrounding the peripheries of the respective four cylinder bores 12*a* is formed between the lower edge of the spacer main body part 14*a* and the bottom portion of the water jacket 13.

An upper support leg 14*e* and a lower support leg 14*f* project to the insides of the upper cooling water passage 13*c* and the lower cooling water passage 13*d*, respectively, from a position at which the cylinder row line L1 intersects the cooling water outlet port part 14*c* on its first end side. In addition, an upper support leg 14*g* and a lower support leg 14*h* project to the insides of the upper cooling water passage 13*c* and the lower cooling water passage 13*d*, respectively, from a position at which the cylinder row line L1 intersects the spacer main body part 14*a* on its second end side (on the side closer to a transmission). For this reason, when the spacer 14 is attached to the inside of the water jacket 13, the lower ends of the respective paired lower support legs 14*f*, 14*h* are in contact with the bottom portion of the water jacket 13, and the upper ends of the respective paired upper support legs 14*e*, 14*g* are in contact with the undersurface of a gasket 16 held between the cylinder block 11 and the cylinder head 15, in the opposite end portions in the cylinder row line L1 direction. Thereby, the spacer 14 is positioned in the up-and-down direction.

Pistons 18 connected to a crankshaft 17 are slidably fitted in the respective cylinder bores 12*a*. Top rings 19, second rings 20 and oil rings 21 are attached to top parts 18*a* of the pistons 18, respectively.

Descriptions will be hereinbelow provided for the detailed structure of the spacer 14 sequentially.

Figure 3:
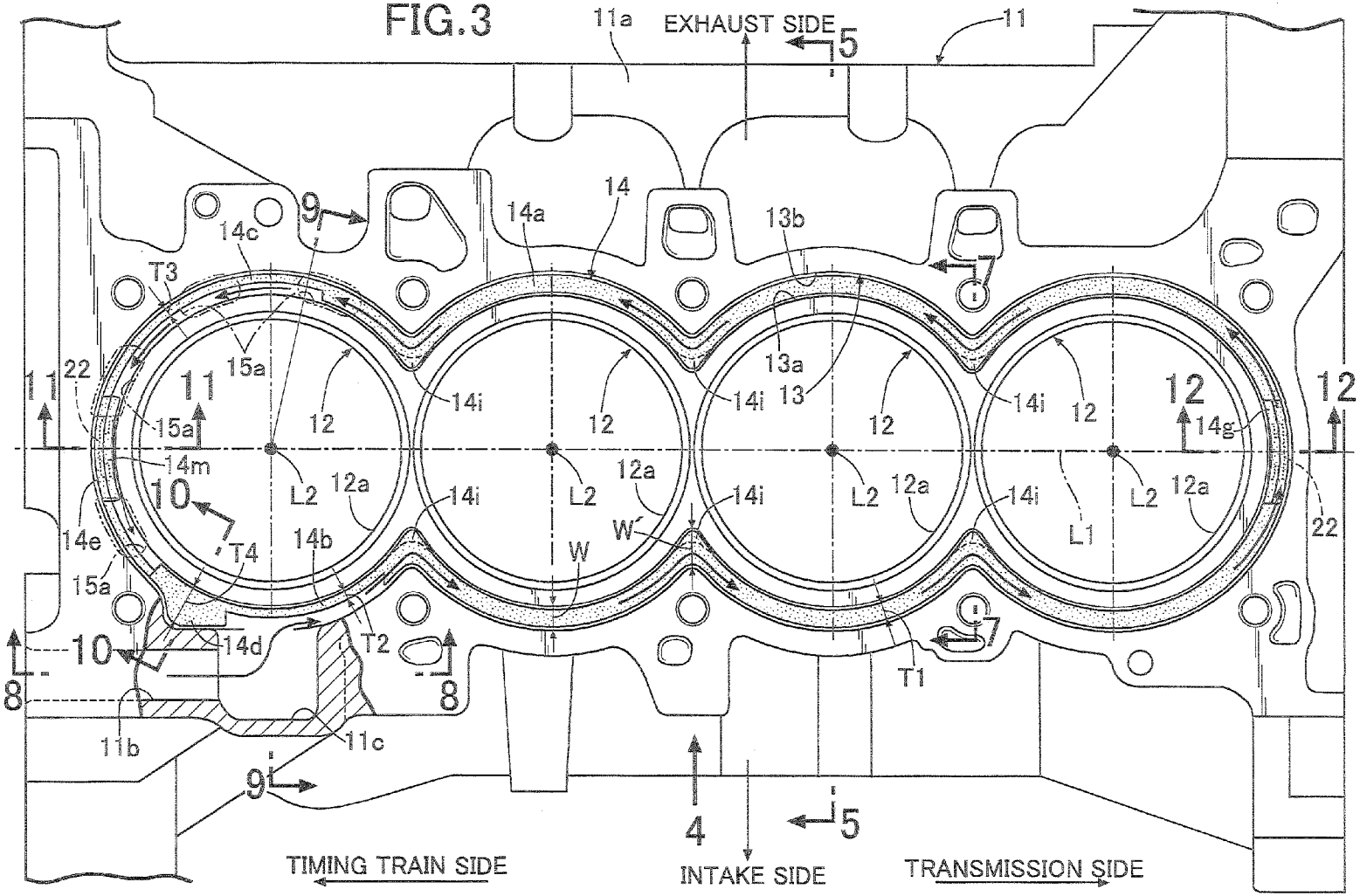
Figure 4:
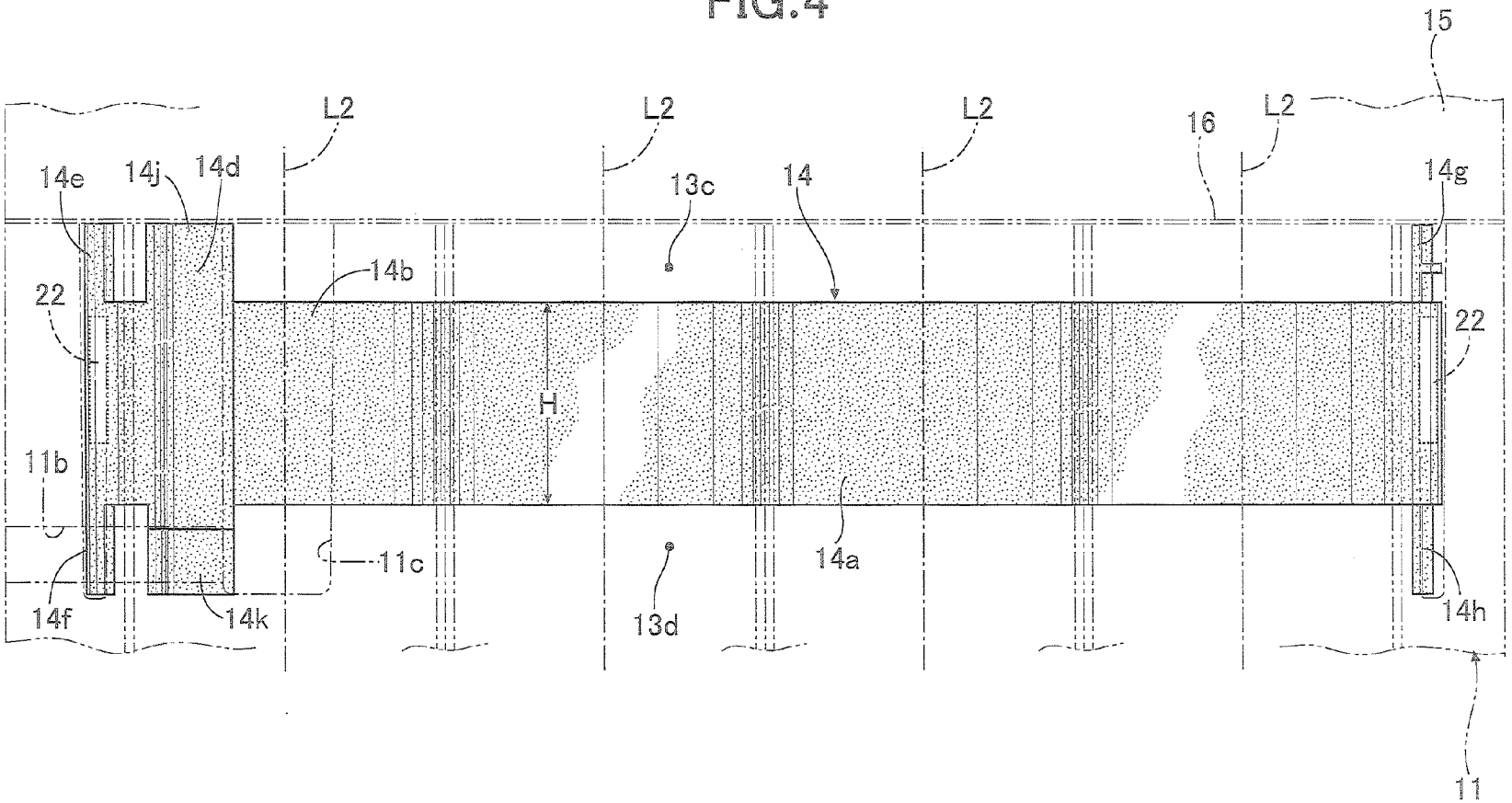

As clear from FIG. 4, the heights of the spacer main body part 14*a*, the cooling water inlet port part 14*b* and the cooling water outlet port part 14*c* of the spacer 14 in a cylinder axis line L2 direction are constant H throughout peripheries thereof. As clear from FIGS. 2 and 3, the thickness T1 of the spacer main body part 14*a* is basically constant. However, the thickness T2 of the cooling water inlet port part 14*b* is thinner than the thickness T1 of the spacer main body part 14*a*, and the thickness T3 of the cooling water outlet port part 14*c* is thinner than the thickness T1 of the spacer main body part 14*a*. In addition, the thickness T4 of the partition wall 14*d* is thicker than the thickness T1 of the spacer main body part 14*a*. The inner peripheral surface of the cooling water inlet port part 14*b* is flush with the inner peripheral surface of the spacer main body part 14*a*. The outer peripheral surface of the cooling water inlet port part 14*b* is offset inward in a radial direction from the outer peripheral surface of the spacer main body part 14*a* by a step. Furthermore, the outer peripheral surface of the cooling water outlet port part 14*c* is flush with the outer peripheral surface of the spacer main body part 14*a*. The inner peripheral surface of the cooling water outlet port part 14*c* is offset outward in the radial direction from the inner peripheral surface of the spacer main body part 14*a* by a step.

Figure 5:
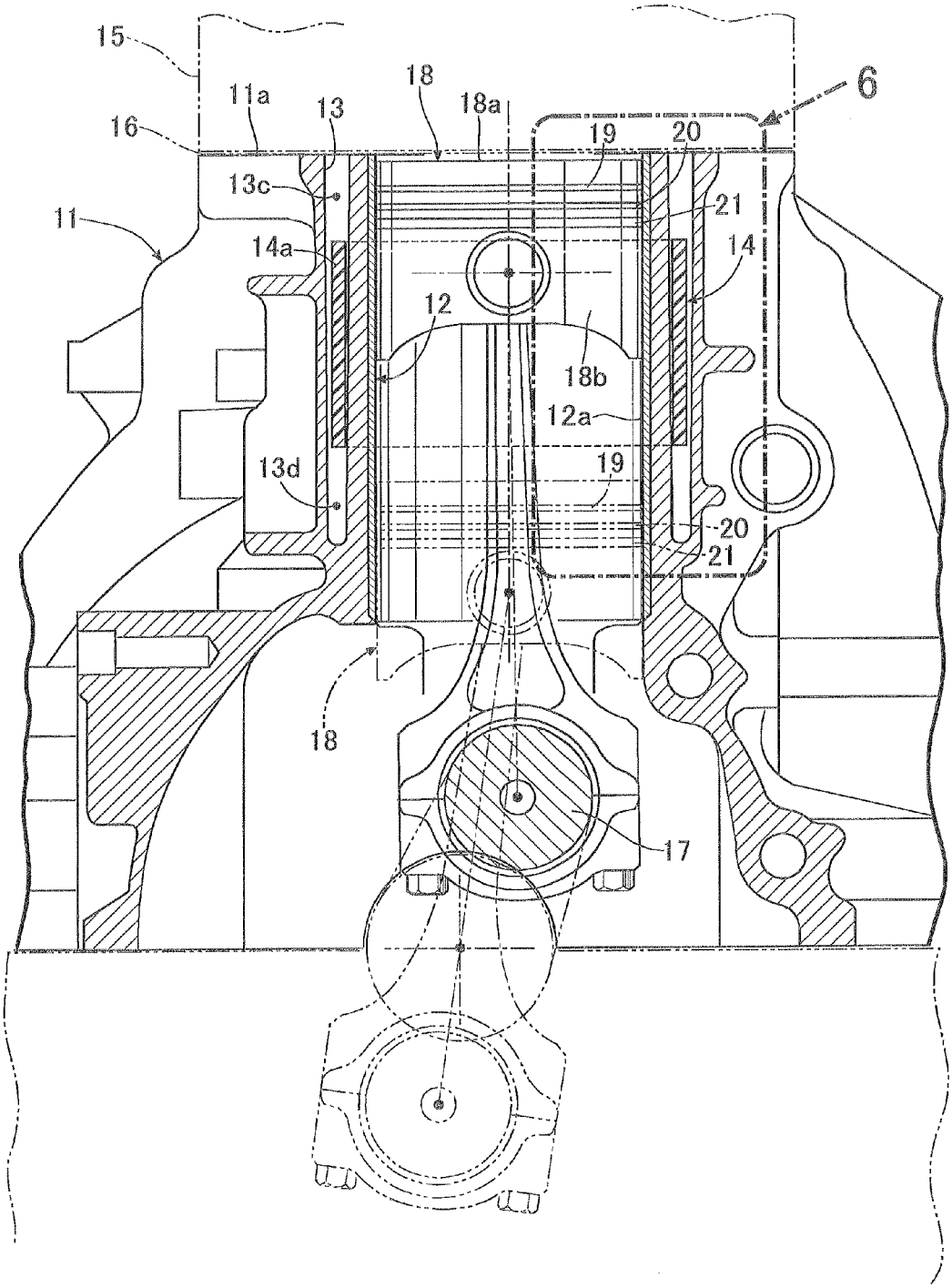

As clear from FIG. 5, while the pistons 18 are moving in the respective cylinder bores 12*a* up and down in response to rotation of the crankshaft 17, side thrusts acting between the pistons 18 and the cylinder bores 12*a* change periodically. Each side thrust reaches a maximum when the corresponding one of the pistons 18 reaches a position of the expansion stroke which is indicated by the continuous line (for example, a position where the crank angle is at 15° after the compression top dead center). The up-and-down position of the spacer 14 inside the water jacket 13 is set in such a way that the top ring 19, the second ring 20 and the oil ring 21 of each of the pistons 18 are located above the upper edge of the spacer 14, and a skirt part 18*b* of the piston 18 is located below the upper edge of the spacer 14 when the piston 18 is located at the position maximizing the side thrust. Furthermore, the up-and-down position of the spacer 14 inside the water jacket 13 is set in such a way that the top ring 19, the second ring 20 and the oil ring 21 of each of the pistons 18 are located below the lower edge of the spacer 14 when the piston 18 is located at the bottom dead center position indicated by the chain line.

Figure 6:
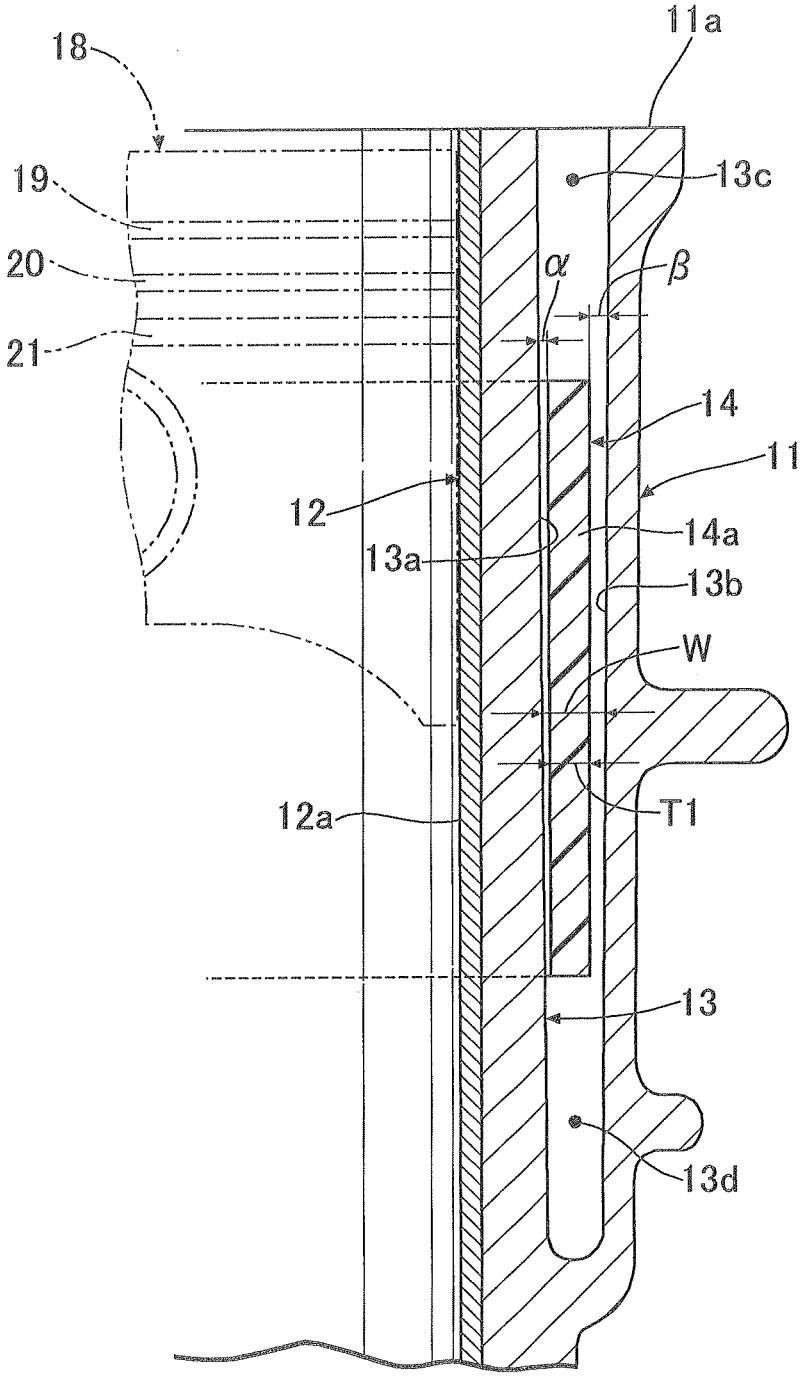

As clear from FIG. 6, the thickness T1 of the spacer main body part 14*a* is set slightly less than the width W of the water jacket 13 in which the spacer main body part 14*a* is fitted. The reason for this is to prevent the assemblability from deteriorating due to friction of the spacer 14 with the inner wall surface 13*a* and the outer wall surface 13*b* of the water jacket 13 resulting from the fact that the dimensional precision of the inner wall surface 13*a* and the outer wall surface 13*b* of the water jacket 13, which have been subjected to no process since casted, is not high. Accordingly, when the spacer 14 is assembled inside the water jacket 13, a space $\alpha$ is formed between the inner peripheral surface of the spacer main body part 14*a* and the inner wall surface 13*a* of the water jacket 13, and a space $\beta$ is formed between the outer peripheral surface of the spacer main body part 14*a* and the outer wall surface 13*b* of the water jacket 13. The spacer main body part 14*a* is arranged therein in such a way that the space $\alpha$ is set smaller than the space $\beta$, that is to say, the spacer main body part 14*a* is closer to the inner wall surface 13*a* of the water jacket 13 than to the outer wall surface 13*b* thereof.

Figure 7:
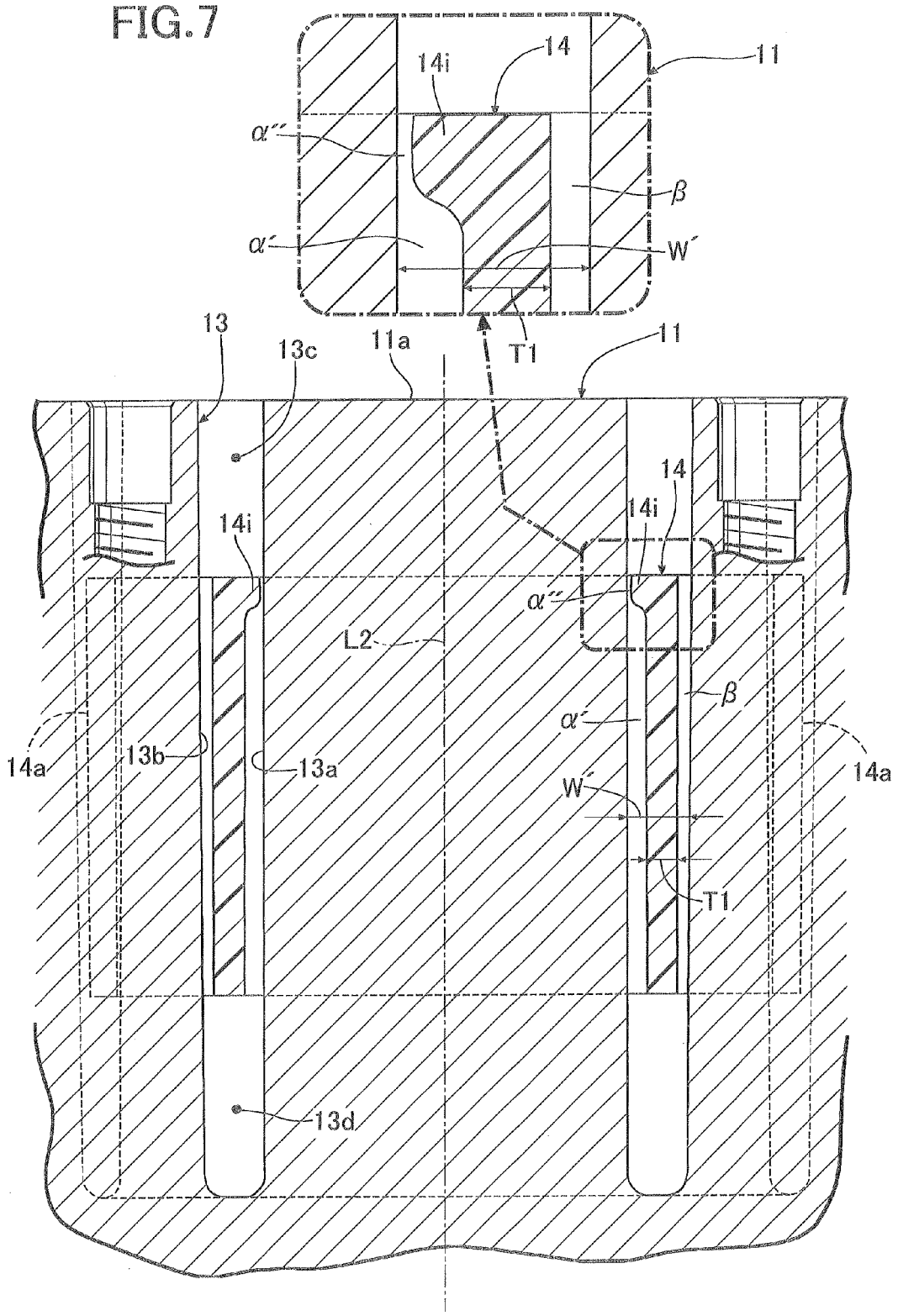
Figure 8:
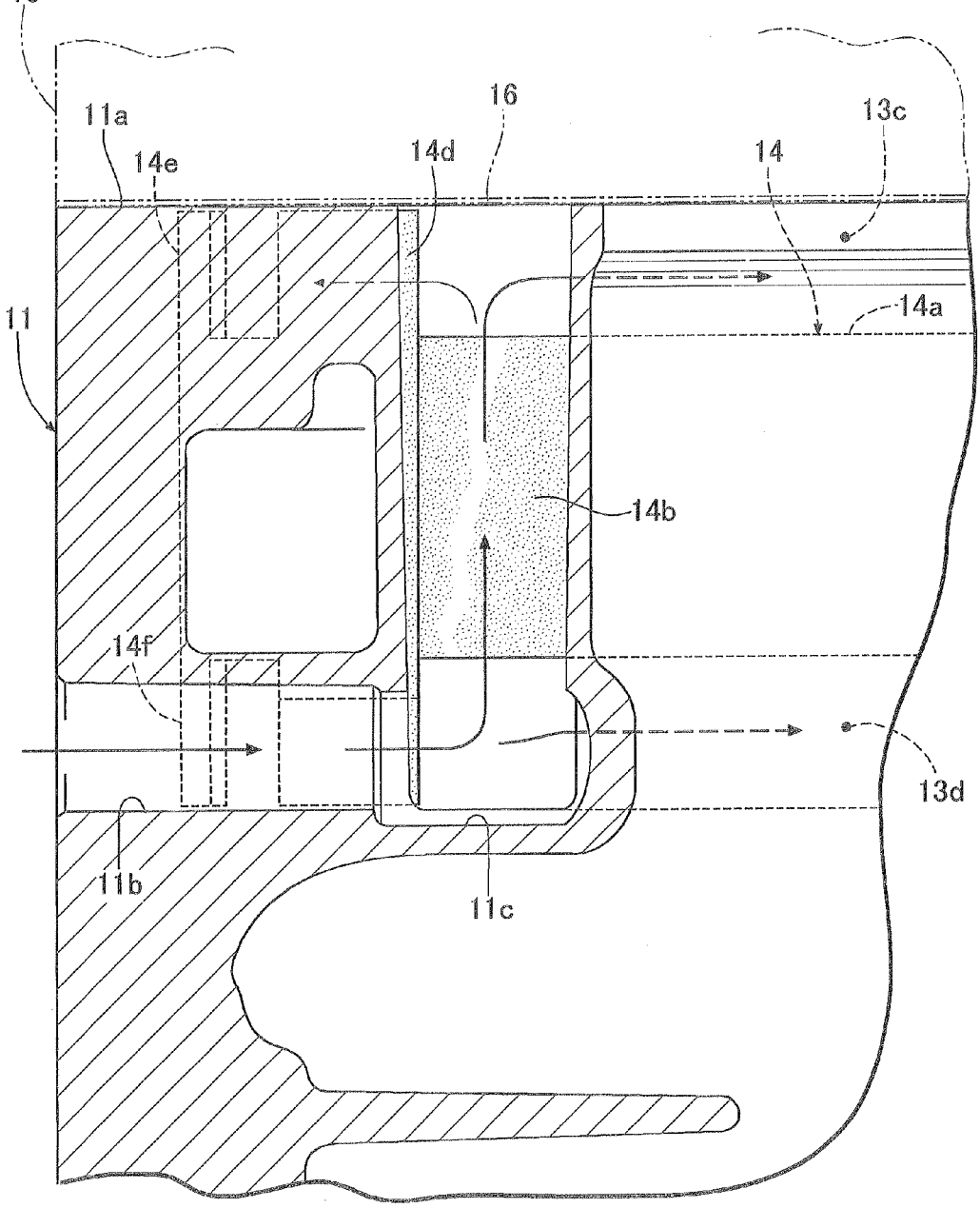
Figure 9:
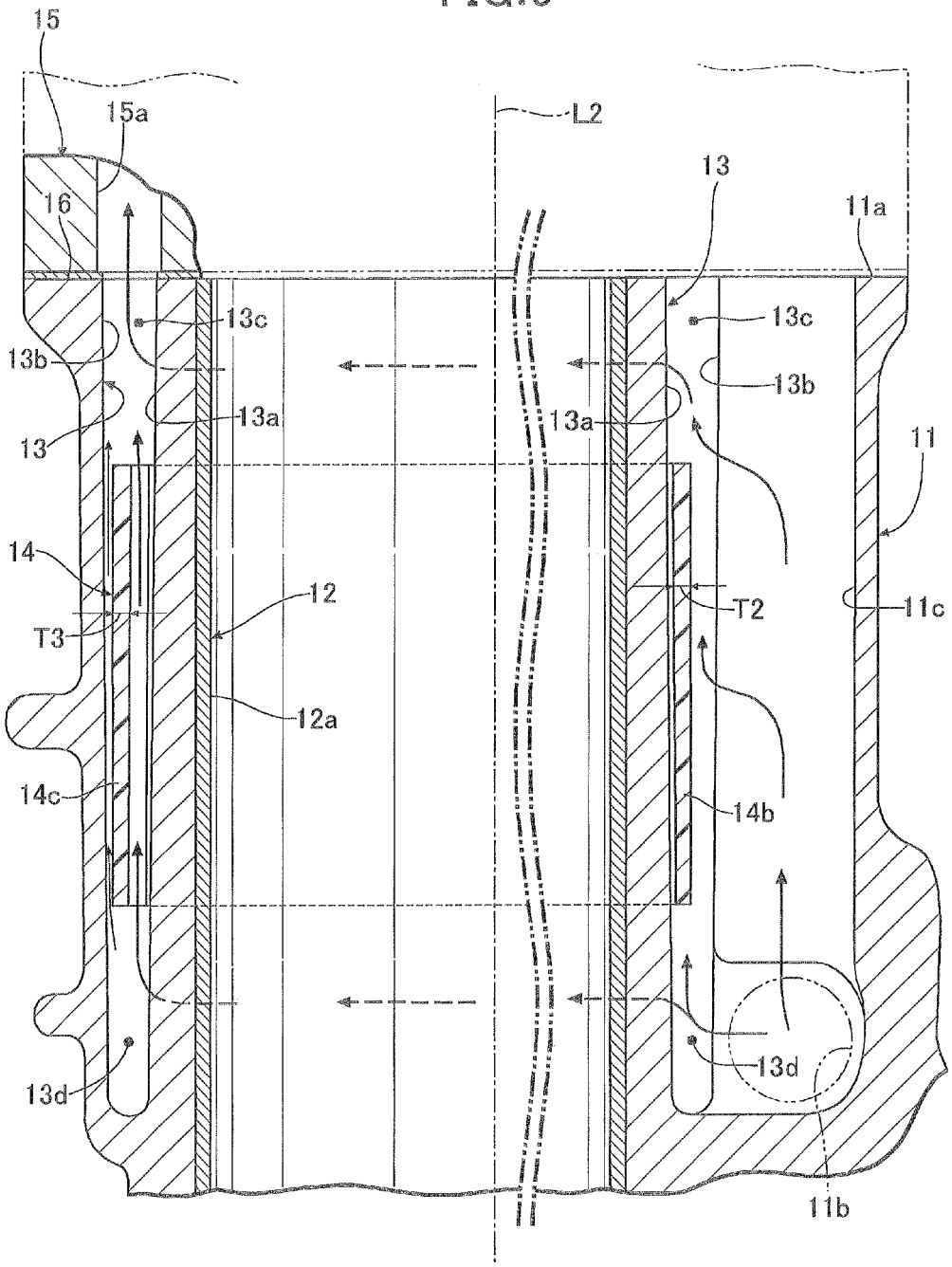
Figure 10:
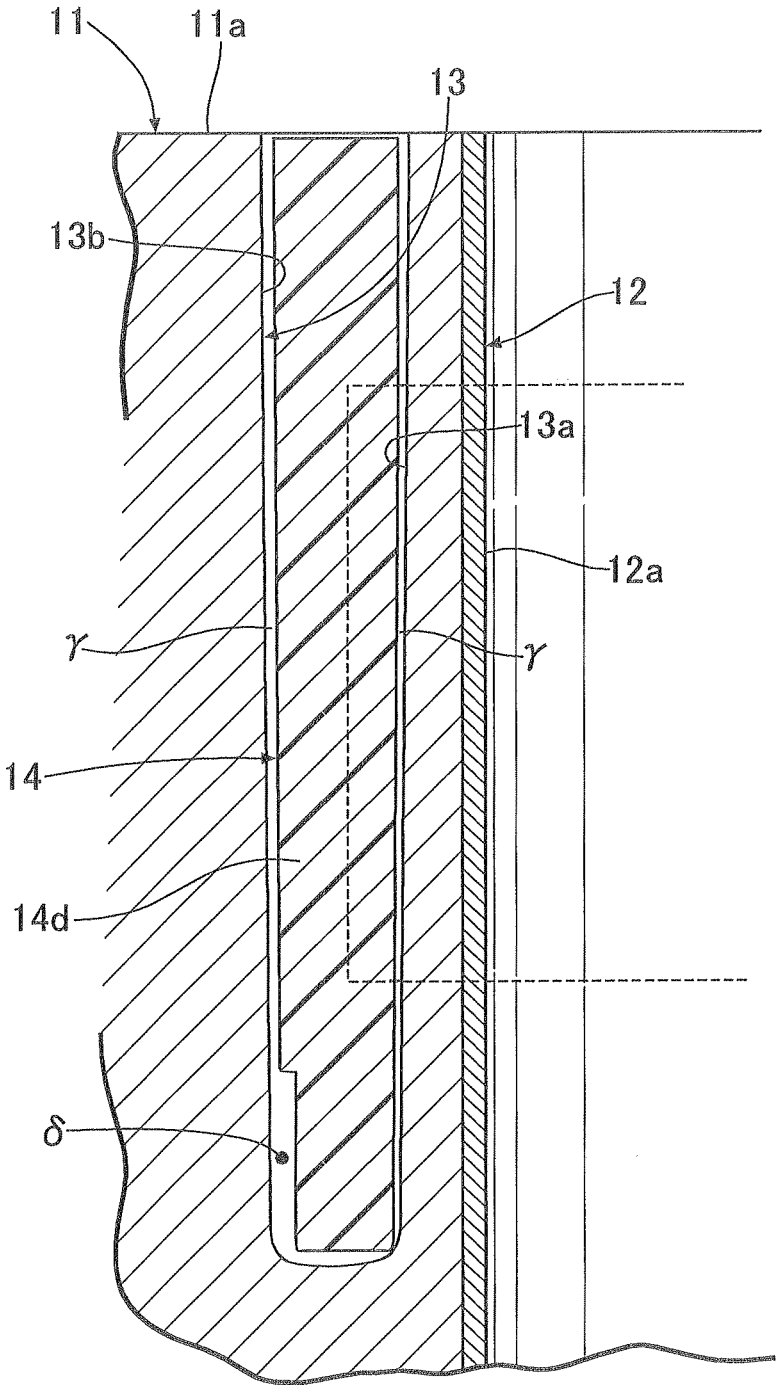
Figure 11B:
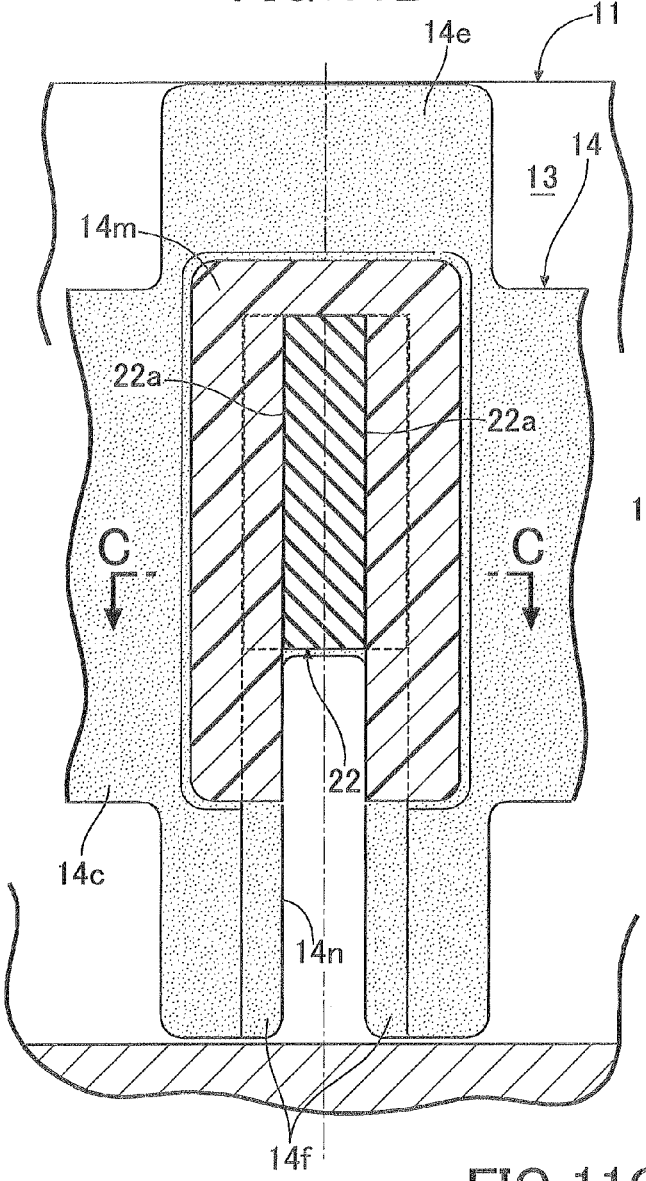
FIG. 11B is a sectional view taken along a line B-B in FIG. 11A.
Figure 11A:
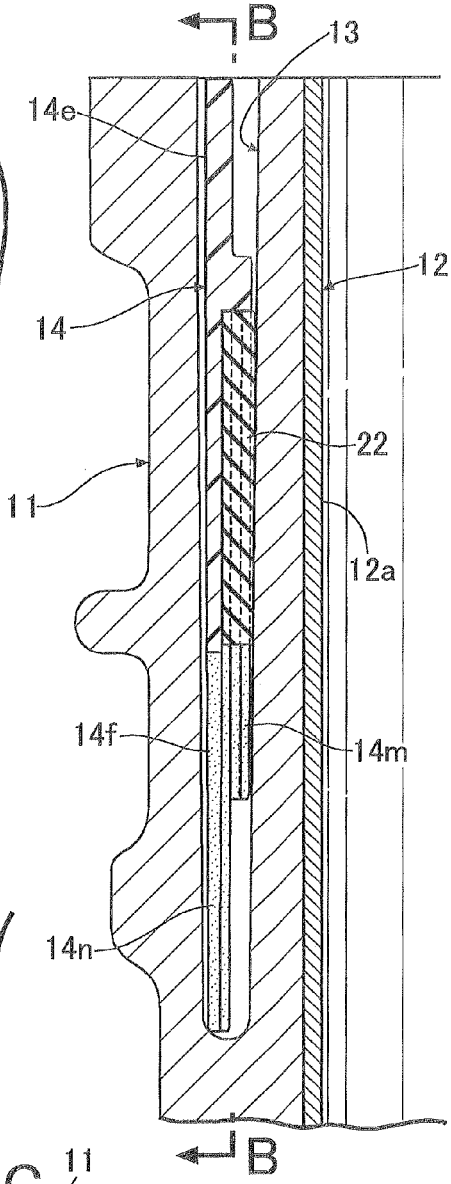
FIG. 11A is a sectional view taken along a line 11-11 in FIG. 3.
Figure 11C:
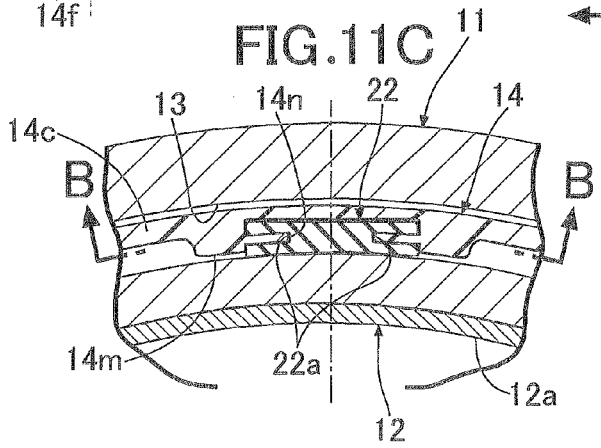
FIG. 11C is a sectional view taken along a line C-C in FIG. 11B.
Figure 12B:
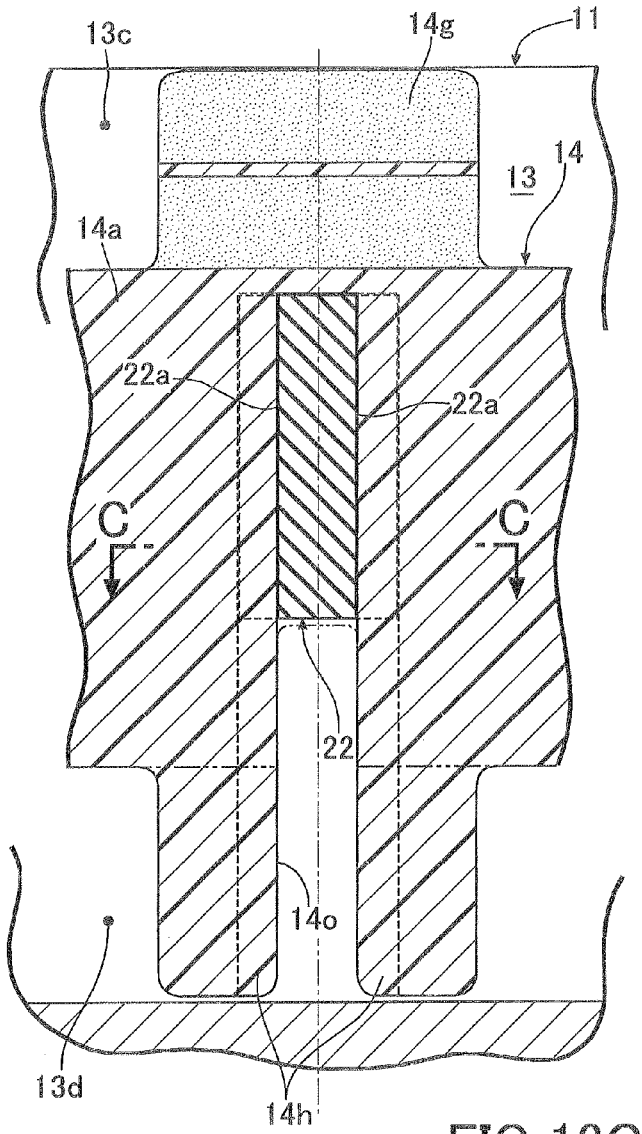
FIG. 12B is a sectional view taken along a line B-B in FIG. 12A.
Figure 12A:
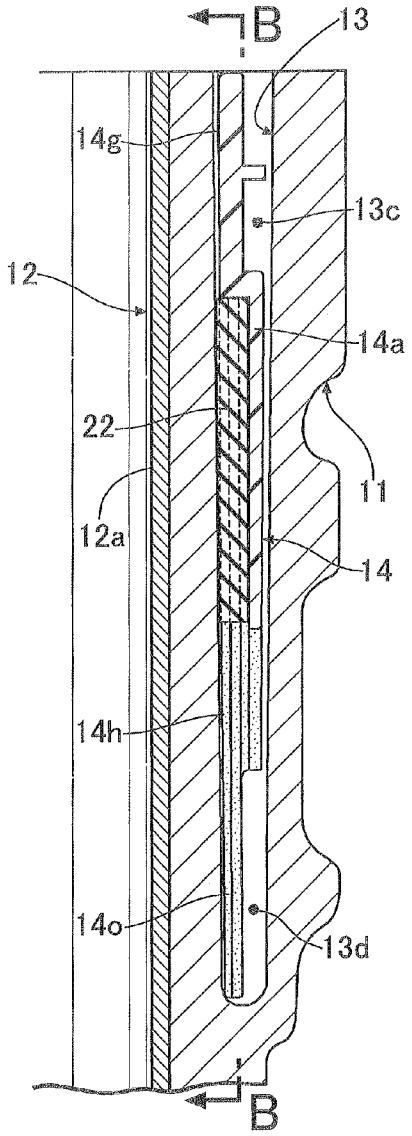
FIG. 12A is a sectional view taken along a line 12-12 in FIG. 3.
Figure 12C:
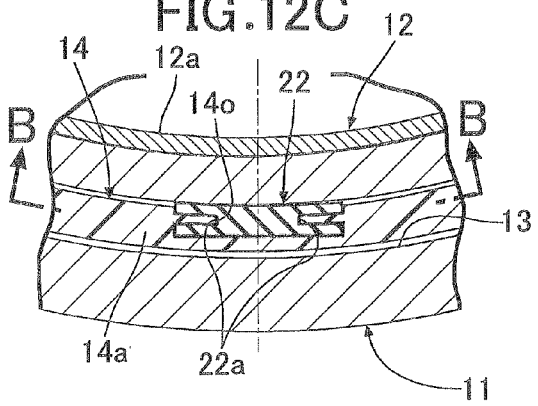

As clear from FIGS. 3 and 7, portions of the water jacket 13 which respectively surround the corresponding two adjacent cylinder sleeves 12, 12 intersect at an acute angle in each inter-bore portion in the cylinder block 11, which is a position at which the corresponding two cylinder sleeves 12, 12 are close to each other. For this reason, a width W' of a portion of the water jacket 13 in a direction orthogonal to the cylinder row line L1 is wider than the width W of any other portion of the water jacket 13. On the other hand, a thickness of a portion of the spacer main body part 14*a* in each inter-bore portion is equal to T1 which is the thickness of any other portion of the spacer main body part 14*a*. For this reason, a space $\alpha'$ between the inner peripheral surface of the spacer main body part 14*a* and the inner wall surface 13*a* of the water jacket 13 in each inter-bore portion is exceptionally larger than the space $\alpha$ therebetween in any other portion.

Nevertheless, in each inter-bore portion in which the corresponding two cylinder sleeves 12, 12 are closer to each other, projection parts 14*i* are formed in an upper end of the spacer main body part 14*a*. A space $\alpha''$ between the tip end portion of each projection part 14*i* and the inner wall surface 13*a* of the water jacket 13 is set smaller than the space $\alpha$.

As clear from FIGS. 1 to 3, 8 and 9, a cooling water supplying passage 11*b* extends from the timing train-side end surface of the cylinder block 11 toward the transmission. A cooling water supplying chamber 11*c* communicating with a downstream end of this cooling water supplying passage 11*b* faces the cooling water inlet port part 14*b* of the spacer 14 which is accommodated in the water jacket 13.

As clear from FIGS. 1 to 3 and FIG. 9, four communication holes 15*a* which are opened in the undersurface of a water jacket (not illustrated) formed in the cylinder head 15 face the upper portion of the cooling water outlet port part 14*c* of the spacer 14 accommodated in the water jacket 13. If the spacer main body part 14*a* would be extended to the position of the cooling water outlet part 14*c*, the position of the cooling water outlet port part 14*c* would roughly overlap the spacer main body part 14*a* thus extended.

As clear from FIGS. 1 to 3 and FIG. 10, the partition wall 14*d* interposed between the cooling water inlet port part 14*b* and the cooling water outlet port part 14*c* of the spacer 14 has a minimum microspace γ (refer to FIG. 10), which enables the spacer 14 to be assembled, between the inner wall surface 13*a* and the outer wall surface 13*b* of the water jacket 13. A microspace δ through which the cooling water can pass is formed between the lower end portion of the partition wall 14*d* and the outer wall surface 13*b* of the water jacket 13. Like the upper support legs 14*e*, 14*g* and the lower support legs 14*f*, 14*h*, the upper end portion and the lower end portion of the partition wall 14*d* has a function of positioning the spacer 14 inside the water jacket 13 in the up-and-down direction.

As clear from FIG. 2 and FIGS. 11A to 11C, a portion interposed between the upper support leg 14*e* and the lower support leg 14*f* in the timing train-side end portion of the spacer 1.4 (a portion corresponding to the cooling water outlet port part 14*c*) is a thickness part 14*m* which is as thick as the spacer main body part 14*a*. A slit 14*n* extending in the up-and-down direction is formed ranging from the lower end of the lower support leg 14*f* to the upper end of the thickness part 14*m*. A slit 22*a* of a rubber-made fixing member 22 having an H-shaped horizontal cross section is fitted in and thus attached to the slit 14*n*. The fixing member 22 is attached thereto in a range of the height in the up-and-down-direction of the spacer main body part 14*a*. Although the outer peripheral surface of the fixing member 22 is not exposed to the outer peripheral surface of the spacer 14, the inner peripheral surface of the fixing member 22 is exposed to the inner peripheral surface of the spacer 14, and thus elastically abuts on the inner wall surface 13*a* of the water jacket 13. A portion of the slit 14*n* which is exposed to the lower support leg 14*f* aims at enhancing the assemblability by decreasing the resistance of pressure-insertion of the fixing member 22.

As clear from FIG. 2 and FIGS. 12A to 12C, a slit 14*o* extending in the up-and-down direction from the lower end of the lower support leg 14*h* to the lower end of the upper support leg 14*g* is formed in the transmission-side end portion of the spacer main body part 14*a*. Another rubber-made fixing member 22 having an H-shaped horizontal cross section is attached to the slit 14*o*. The fixing member 22 is attached thereto in a range of the height in the up-and-down-direction of the spacer main body part 14*a*. Although the outer peripheral surface of the fixing member 22 is not exposed to the outer peripheral surface of the spacer 14, the inner peripheral surface of the fixing member 22 is exposed to the inner peripheral surface of the spacer 14, and thus elastically abuts on the inner wall surface 13*a* of the water jacket 13. A portion of the slit 14*o* which is exposed to the lower support leg 14*h* aims at enhancing the assemblability by decreasing the resistance of pressure-insertion of the fixing member 22.

The two fixing members 22, 22 both are arranged on the cylinder row line L1. Accordingly, the intake side portion and the exhaust side portion of the spacer 14 are basically symmetrical with respect to a line joining the two fixing members 22, 22 (in other words, the cylinder row line L1).

The slits 14*n*, 14*o* are opened downward. The fixing members 22, 22 are upward fitted in the slits 14*n*, 14*o*, respectively. For these reasons, when the spacer 14 to which the fixing members 22, 22 are attached is inserted inside the water jacket 13, the fixing members 22, 22 are unlikely to come off the slits 14*n*, 14*o* even if the fixing members 22, 22 are pushed upward by friction forces acting between the fixing members 22, 22 and the inner wall surface 13*a* of the water jacket 13.

Next, descriptions will be provided for the operation of the embodiment of the present invention having the foregoing configuration.

Before the cylinder head 15 is assembled to the deck surface 11*a* of the cylinder block 11, the water jacket 13 is opened to surround the outer peripheries of the cylinder bores 12*a* of the four cylinder sleeves 12 exposed to the deck surface 11*a*, respectively. The spacer 14 is inserted inside the water jacket 13 from the opening. Thereafter, the cylinder head 15 is fastened to the cylinder block 11 with the gasket 16 overlapping the deck surface 11*a* of the cylinder block 11.

When this spacer 14 is assembled therein, the lower ends of the lower support legs 14*f*, 14*h* and the lower end of a lower protrusion 14*k* of the partition wall 14*d* is in contact with the bottom portion of the water jacket 13, as well as the upper ends of the upper support legs 14*e*, 14*g* and the upper end of an upper protrusion 14*j* of the partition wall 14*d* are in contact with the undersurface of the gasket 16. Thereby, the spacer 14 is positioned in the cylinder axis line L2 direction. At this time, the inner peripheral surface of the spacer main body part 14*a* of the spacer 14 is arranged close to the inner wall surface 13*a* of the water jacket 13. However, because the dimensional precision of the inner wall surface 13*a* of the water jacket 13 which has been subjected no process since casted is not high, the slight space α (refer to FIG. 6) is formed between the inner peripheral surface of the spacer main body part 14*a* and the inner wall surface 13*a* of the water jacket 13 for the purpose of preventing the assemblability from deteriorating due to friction of the spacer 14 with the inner wall surface 13*a* of the water jacket 13.

If the spacer 14 moves in the up-and-down direction inside the water jacket 13 due to vibrations and the like during the operation of the internal combustion engine, there is a possibility that the upper ends of the upper support legs 14*e*, 14*g* and the upper end of the upper protrusion 14*j* of the partition wall 14*d* may damage the undersurface of the gasket 16. However, the two fixing members 22, 22 provided on the respective opposite ends in the cylinder row line L1 direction fix the spacer 14 to the water jacket 13 in order that the spacer 14 cannot move relative to the water jacket 13. This prevents haphazard movement of the spacer 14 from damaging the gasket 16.

At this time, not only can the spacer 14 be firmly fixed to the inside of the water jacket 13 because the fixing member 22, 22 are provided in the respective two highly-rigid end portions of the spacer 14 in the cylinder row line L1 direction, but also the influence of heat on the rubber-made fixing members 22, 22 attached to the respective opposite end portions of the cylinder block 11 in the cylinder row line L1 direction can be suppressed to a minimum because the opposite end portions of the cylinder block 11 are lower in temperature than the intake-side and exhaust-side side surfaces of the cylinder block 11.

In addition, because the fixing members 22, 22 are provided in the respective intermediate portions of the spacer 14 in the cylinder axis line L2 direction, in other words, in the range of the height of the spacer main body part 14*a*, it is possible to prevent the blockage of the flow of the cooling water in the upper cooling water passage 13*c* and in the lower cooling water passage 13*d* by the fixing members 22, 22, which would otherwise occur. In addition, because the timing train-side fixing member 22 of the spacer 14 is provided in the cooling water outlet port part 14*c*, the fixing member 22 does not affect the flow of the cooling water in the upper cooling water passage 13*c* and in the lower cooling water passage 13*d*. Furthermore, the flow speed of the cooling water decreases due to the U-turn of the cooling water in the transmission-side end portion of the water jacket 13. Accordingly, the influence of the fixing member 22 on the flow of the cooling water can be made smaller when the fixing member 22 is provided in the transmission-side end portion of the water jacket 13 than when the fixing member 22 is provided in the intake-side and exhaust-side side wall of the water jacket 13.

The timing train-side upper support leg 14*e* and lower support leg 14*f* of the spacer 14 are formed thinner in the radial direction than the thickness T1 of the spacer main body part 14*a*, and are arranged offset toward the outer wall surface 13*b* of the water jacket 13 inside the upper cooling water passage 13*c* and the lower cooling water passage 13*d*. In addition, the transmission-side upper support leg 14*g* and the lower support leg 14*h* of the spacer 14 are formed thinner in the radial direction than the thickness T1 of the spacer main body part 14*a*, and are arranged offset toward the inner wall surface 13*a* of the water jacket 13 inside the upper cooling water passage 13*c* and the lower cooling water passage 13*d*. Thereby, the influence of the upper support legs 14*e*, 14*g* and the lower support legs 14*f*, 14*h* on the flow of the cooling water in the upper cooling water passage 13*c* and in the lower cooling water passage 13*d* can be suppressed to a minimum. In addition, the upper support legs 14*e*, 14*g* and the lower support legs 14*f*, 14*h* are curved in the shape of an arc along the forms of the inner wall surface 13*a* and the outer wall surface 13*b* of the water jacket 13. Accordingly, the influence on the flow of the cooling water can be made much smaller.

Furthermore, out of the four cylinder bores 12*a*, their portions situated outermost in the cylinder row line L1 direction are less susceptible to heat from the other cylinder bores 12*a*. For this reason, the temperature of such portions is relatively low. On the other hand, out of the four cylinder bores 12*a*, portions situated on the intake side and exhaust side of the cylinder row line L1 are susceptible to heat from their adjacent cylinder bores 12*a*. For this reason, the temperature of such portions is relatively high. In the present embodiment, the upper support legs 14*e*, 14*g* and the lower support legs 14*f*, 14*h* are provided in the outermost positions in the cylinder row line L1 direction in which the temperature of the cylinder bores 12*a* is relatively low. For this reason, even if the flow of the cooling water in the water jacket 13 is more or less blocked by the upper support legs 14*e*, 14*g* and the lower support legs 14*f*, 14*h*, the influence can be suppressed to a minimum, and the temperatures of the respective cylinder bores 12*a* can be made uniform.

In particular, the transmission-side upper support leg 14*g* and lower support leg 14*h* are arranged along the inner wall surface 13*a* of the water jacket 13 which faces the transmission-side lower-temperature portion of the corresponding cylinder bore 12*a*. For this reason, it is possible to make the cooling water less likely to come into contact with the inner wall surface 13*a* of the water jacket 13 by use of the upper support leg 14*g* and the lower support leg 14*h*, and to thermally insulate the cylinder bore 12*a*, whose temperature is relatively low. This makes it possible to make the temperatures of the respective cylinder bores 12*a* much more uniform.

The fixing members 22, 22 are made of the rubber, as well as are fitted in and fixed to the slits 14*n*, 14*o* of the spacer 14. For this reason, the fixing members 22, 22 can be fixed to the spacer 14 without any specialized members, such as bolts. In addition, the positions at which the fixing members 22, 22 are provided are immediately above the lower support legs 14*f*, 14*h*. For this reason, it is possible to prevent the spacer 14 from deforming in a twisted manner when: the spacer 14 is downward pushed into the inside of the water jacket 13 while putting the fixing members 22, 22 in pressure contact with the inner wall surface 13*a* of the water jacket 13; the lower ends of the lower support legs 14*f*, 14*h* subsequently come in contact with the bottom portion of the water jacket 13; and the spacer 14 receives an upward force.

During the operation of the internal combustion engine, the cooling water supplied from a water pump (not illustrated) provided to the cylinder block 11 flows into the water jacket 13 from the cooling water supplying passage 11*b*, which is provided in the timing train-side end portion of the cylinder block 11, through the cooling water supplying chamber 11*c*. The spacer 14 is arranged inside the water jacket 13. The thickness T2 of the cooling water inlet port part 14*b* of the spacer 14, which faces the cooling water supplying chamber 11*c*, is thinner than the thickness T1 of the spacer main body part 14*a*. In addition, the cooling water inlet port part 14*b* is offset inward in the radial direction. For these reasons, the flow of the cooling water bifurcates into upper and lower streams along the radial-direction outer surface of the cooling water inlet port part 14*b*, and the cooling water thus smoothly flows into the upper cooling water passage 13*c* and the lower cooling water passage 13*d* of the water jacket 13.

The cooling water having flown into the upper cooling water passage 13*c* and the lower cooling water passage 13*d* of the water jacket 13 tends to bifurcate in the left and right directions. However, the flow of the cooling water is once blocked by the partition wall 14*d* existing on the left of the cooling water inlet port part 14*b*. For this reason, the direction of the flow of the cooling water is turned to the right. Subsequently, the cooling water flows counterclockwise in the upper cooling water passage 13*c* and the lower cooling water passage 13*d* in almost full length. Finally, the cooling water is discharged to the communication holes 15*a* in the cylinder head 15 from the cooling water outlet port part 14*c* which is situated on the opposite side of the partition wall 14*d* from the cooling water inlet port part 14*b*. While the cooling water is flowing in the water jacket 13, the cooling water flowing in the upper cooling water passage 13*c* and the cooling water flowing in the lower cooling water passage 13*d* hardly ever mingle with each other, because the upper cooling water passage 13*c* and the lower cooling water passage 13*d* are partitioned vertically by the spacer main body part 14*a* whose thickness T1 is slightly thinner than the width W of the water jacket 13.

When the cooling water having flown in the water jacket 13 is discharged to the water jacket (not illustrated) in the cylinder head 15 through the communication holes 15*a* opened to the undersurface of the cylinder head 15, the cooling water having flown in the lower cooling water passage 13*d* passes the cooling water outlet port part 14*c* of the spacer 14 from its lower part to its upper part, and thus joins the cooling water having flown in the upper cooling water passage 13*c*. Thereafter, the confluent cooling water flows into the communication holes 15*a* in the cylinder head 15.

At this time, not only can loss of the pressure of the cooling water upward passing the cooling water outlet port part 14*c* be suppressed to a minimum, but also the cooling effect can be secured even in a vicinity of the cooling water outlet port part 14*c*, in which the cooling effect decreases due to reduction in the flow rate of the cooling water, by causing as much cooling water as possible to intervene between the cooling water outlet port part 14*c* and the inner wall surface 13*a* of the water jacket 13. That is because: the cooling water outlet port part 14*c* is offset toward the outer wall surface 13*b* of the water jacket 13 with the thickness T3 of the cooling water outlet port part 14*c* being less than the thickness T1 of the spacer main body part 14*a* and with the outer peripheral surface being flush with the outer peripheral surface of the spacer main body part 14*a*.

In addition, the cooling water having come out of the downstream end of the upper cooling water passage 13*c* joins the cooling water having changed its flow direction upward after coming out of the downstream end of the lower cooling water passage 13*d*. Accordingly, the direction of the cooling water having come from the upper cooling water passage 13*c* can be changed upward by the cooling water having coming from the lower cooling water passage 13*d*, and the cooling water having come from the upper cooling water passage 13*c* can be made to flow into the communication holes 15*a* smoothly.

When the cooling water having flown in the upper cooling water passage 13*e* and the lower cooling water passage 13*d* is discharged from the communication holes 15*a* after changing its direction upward at the cooling water outlet port part 14*c*, there is a possibility that: swirls of the cooling water may occur; and the smooth direction change may be hindered. However, the flow of the cooling water into the communication holes 15*a* can be achieved by preventing the occurrence of the swirls, because a portion of the cooling water in the cooling water inlet port part 14*b* flows into the cooling water outlet port part 14*c* after passing the space δ (refer to FIG. 10) in the lower end portion of the partition wall 14*d*.

The inner peripheral surface of the spacer main body part 14*a* of the spacer 14 is close to the inner wall surface 13*a* at the intermediate portion of the water jacket 13 in the cylinder axis lines L2 direction. Accordingly, only a less amount of the cooling water comes into contact with the inner wall surface 13*a*, and the cooling is suppressed. As a result, the intermediate portions of the cylinder bores 12*a* in the cylinder axis lines L2 direction, which are opposed to the spacer main body part 14*a*, become higher in temperature than the other portions thereof, and thermally expand to have larger clearances between the cylinder bores 12*a* and their corresponding pistons 18. As a consequence, frictions between the pistons 18 and the cylinder bores 12*a* are reduced, particularly when large side thrusts are applied to the respective pistons 18 during the compression process and the expansion process. Accordingly, it is possible to contribute to improving fuel efficiency of the internal combustion engine. Furthermore, because the intermediate portions of the cylinder bores 12*a* in the cylinder axis lines L2 direction become higher in temperature than any other portions thereof, the temperature of the oil lubricating such portions rises, and the viscosity of the oil decreases. For this reason, the effect of friction reduction is enhanced more.

On the other hand, the upper portions and lower portions of the cylinder bores 12*a* in the cylinder axis lines L2 direction are sufficiently cooled by the cooling water flowing in the upper cooling water passage 13*c* and the lower cooling water passage 13*d* above and under the spacer 14. Accordingly, it is possible to secure the cooling performances of the top parts 18*a* and the skirt parts 18*b* of the pistons 18 slidably fitted in the cylinder bores 12*a* and to prevent their overheat, although the temperatures of the top parts 18*a* and the skirt parts 18*b* would otherwise tend to rise. Moreover, not only does the upper portions of the cylinder bores 12*a* directly receive heat of a combustion chamber, but also the upper portions thereof tend to raise their temperatures due to their reception of heat transmitted through the top rings 19, the second rings 20 and the oil rings 21 from the heated pistons 18 which stay at the vicinities of their top dead centers for long time due to the change in their movement directions. However, because no spacer 14 is made to face the upper portions of the cylinder bores 12*a*, their cooling performances can be secured. In addition, the skirt parts 18*b* of the pistons 18 are places which are most tightly put in sliding contact with the cylinder bores 12*a*, thereby causing friction therebetween. However, because the cylinder bores 12*a* with which the skirt parts 18*b* are put in sliding contact are covered with the spacer 14 and the diameters of the cylinder bores 12*a* is increased by thermal expansion, the friction can be reduced.

As indicated by the continuous line in FIG. 5, the up-and-down position of the spacer 14 is set in such a way that the top rings 19, the second rings 20 and the oil rings 21 are situated above the upper edge of the spacer main body part 14*a*, when the side thrusts of the respective pistons 18 reach their maximum during the expansion process, in other words, when the friction between the pistons 18 and the cylinder bores 12*a* reaches its maximum. For this reason, the cooling performance of the pistons 18 can be secured by: reducing the friction by increasing the inner diameters of the cylinder bores 12*a* by use of the spacer 14; and concurrently making the heat of the top parts 18*a* of the heated pistons 18 whose temperature tend to be higher, escape to the upper cooling water passage 13*c* of the water jacket 13 from the highly heat-conductive top rings 19, second rings 20 and oil rings 21 through the cylinder bores 12*a*.

At this time, because the spacer main body part 14*a* of the spacer 14 is close to the inner wall surface 13*a* of the water jacket 13 with the minimum space α being interposed in between, it is possible to suppress the amount of cooling water intervening between the spacer main body part 14*a* and the inner wall surface 13*a* of the water jacket 13 to a minimum, and thus to thermally insulate the up-and-down-direction intermediate portions of the cylinder bores 12*a* effectively, as well as to enlarge the diameters of the cylinder bores 12*a*.

In addition, at the bottom dead centers indicated by the chain line in FIG. 5, the quantity of heat transmitted to the cylinder bores 12*a* from the pistons 18 through the top rings 19, the second rings 20 and the oil rings 21 is larger because the speeds at which the pistons 18 move decrease. However, when the pistons 18 reaches their bottom dead centers, the top rings 19, the second rings 20 and the oil rings 21 are situated below the lower edge of the spacer main body part 14*a*. For this reason, it is possible to make the heat of the pistons 18 escape to the cylinder bores 12*a* without being obstructed by the spacer 14, and to secure the cooling performances of the pistons 18.

Moreover, when the spacer 14 is assembled inside the water jacket 13, the space α between the inner peripheral surface of the spacer main body part 14*a* and the inner wall surface 13*a* of the water jacket 13 is set smaller than the space β between the outer peripheral surface of the spacer main body part 14*a* and the outer wall surface 13*b* of the water jacket 13. For this reason, the outer peripheral surface of the spacer main body part 14*a* is designed not to come in contact with the outer wall surface 13*b* of the water jacket 13, even though: the spacer 14 may deviate in the radial direction due to the assembling error and its deformation; and the inner peripheral surface of the spacer main body part 14*a* may come into contact with the inner wall surface 13*a* of the water jacket 13.

Because, as described above, the space is always secured between the outer peripheral surface of the spacer main body part 14*a* and the outer wall surface 13*b* of the water jacket 13, the following operation/working effects are exerted. To put it specifically, if unlike the present embodiment, the outer peripheral surface of the spacer main body part 14*a* would come in contact with the outer wall surface 13*b* of the water jacket 13, the hitting sounds of the pistons 18 would be propagated via pathways from the cylinder bores 12*a*, the bottom portion of the water jacket 13, the lower support legs 14*f*, 14*h* of the spacer 14, the spacer main body part 14*a* to the outer wall surface 13*b* of the water jacket 13, and accordingly would constitute the cause of noises, because the lower support legs 14*f*, 14*h* of the spacer 14 are in contact with the bottom portion of the water jacket 13. Meanwhile, in the present embodiment, although hitting sounds of the pistons 18 are propagated from the cylinder bores 12*a* to the spacer main body part 14*a*, the hitting sounds are blocked in the spacer main body part 14*a* because the spacer main body part 14*a* does not abut on the outer wall surface 13*b* of the water jacket 13, thereby reducing noises.

If the spacer 14 deforms due to its swelling resulting from its contact with the cooling water and its thermal expansion, there is a possibility that the inner peripheral surface of the spacer 14 may be tightly fitted to the inner wall surface 13*a* of the water jacket 13. However, because the projection parts 14*i* provided on the spacer main body part 14*a* are opposed to the inner wall surface 13*a* of the water jacket 13 to come in contact with the inner wall surface 13*a* thereof, it is possible to prevent the inner peripheral surface of the spacer main body part 14*a* and the inner wall surface 13*a* of the water jacket 13 from coming into intimate contact with each other throughout their surfaces. Note that if the projection parts 14*i* come in contact with the inner wall surface 13*a* of the water jacket 13, there is a possibility that the hitting sounds may be propagated through the projection parts 14*i*. Basically, however, hitting sounds largely occur in the intake-side and exhaust-side portions of the outer peripheral surface of the pistons 18 which are distant from the cylinder row line L1, and hitting sounds hardly ever occur in portions close to the cylinder row line L1 in which the projection parts 14*i* are provided. For this reason, the propagation of hitting sounds through the projection parts 14*i* substantially does not matter.

Figure 2:
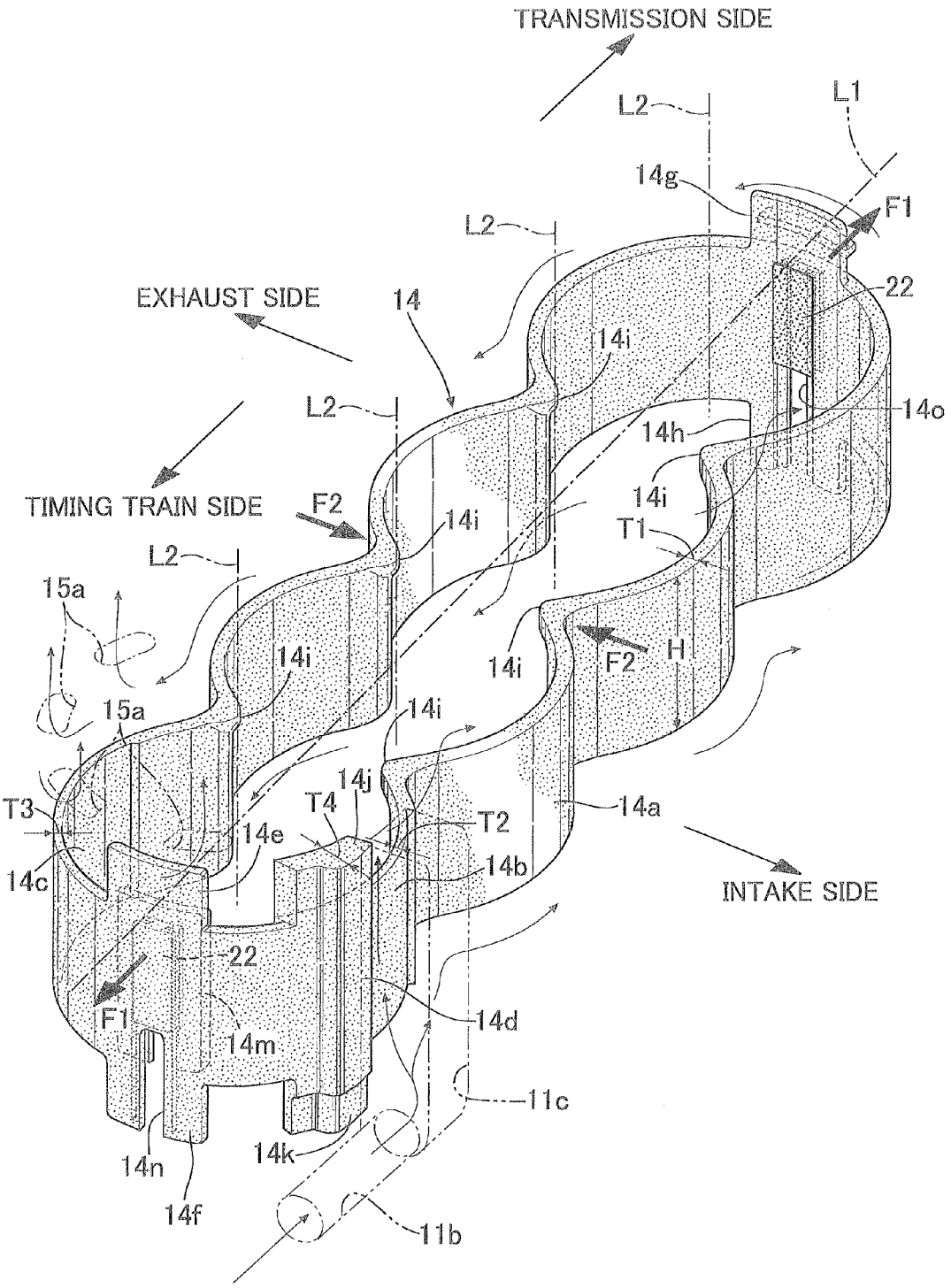

In addition, as shown in FIG. 2, the spacer 14 is stretched in the cylinder row line L1 direction by the reaction forces F1, F1, because the fixing members 22, 22 provided in the respective opposite end portions of the spacer 14 in the cylinder row line L1 direction elastically contact the inner wall surface 13*a* of the water jacket 13. As a result, the intake-side and exhaust-side side surfaces of the spacer main body part 14*a* deform by receiving loads F2, F2 working in a direction in which the intake-side and exhaust-side side surfaces thereof come closer to each other. For this reason, the inner peripheral surface of the spacer main body part 14*a* comes closer to the inner wall surface 13*a* of the water jacket 13, and the space $\alpha$ between the inner peripheral surface of the spacer main body part 14*a* and the inner wall surface 13*a* of the water jacket 13 decreases accordingly. Thereby, the amount of cooling water intervening between the spacer main body part 14*a* and the inner wall surface 13*a* of the water jacket 13 can be reduced more, and the up-and-down-direction intermediate portions of the cylinder bores 12*a* thus can be thermally insulated more effectively, as well as the diameters thereof can be enlarged.

At this time, the two fixing members 22, 22 both are arranged on the cylinder row line L1, and the intake-side portion and exhaust-side portion of the spacer 14 are basically symmetrical with respect to the cylinder row line L1. For this reason, the loads F2, F2 which cause the intake-side and exhaust-side side surfaces of the spacer main body part 14*a* to come closer to each other can be made uniform, and the amount of deformation of the intake-side portion of the spacer 14 and the amount of deformation of the exhaust-side portion of the spacer 14 can be made uniform.

Furthermore, because the fixing members 22, 22 are attached to the spacer main body part 14*a* in a way not to cut into the upper cooling water passage 13*c* or the lower cooling water passage 13*d*, the fixing members 22, 22 do not obstruct the flow of the cooling water. In addition, because the fixing member 22, 22 are attached to the spacer main body part 14*a* in a way not to interfere with the upper support legs 14*e*, 14*g* or the lower support legs 14*f*, 14*h* of the spacer 14, the spacer main body part 14*a* can be efficiently deformed with the resilient forces of the fixing members 22, 22.

Although the foregoing descriptions have been provided for the embodiment of the present invention, various design changes may be applied to the present invention within the scope not departing from the gist of the present invention.

For example, the internal combustion engine with four cylinders mounted in a straight line has been shown as an example of the embodiment. However, the present invention can be applied to an internal combustion engine of any arbitrary mode of any arbitrary number of cylinders.

In addition, the present invention can be applied to an internal combustion engine in which: the cooling water supplied from one end side of the cylinder row line L1 is bifurcated into two streams flowing along the intake-side side surface and the exhaust-side side surface, respectively; then the two streams are made confluent in the other end side of the cylinder row line L1; and the confluent cooling water is discharged therefrom.

Furthermore, in the embodiment, the top rings 19, the second rings 20 and the oil rings 21 are made to correspond to the piston rings according to the present invention. However, the top rings 19 alone may be made to correspond to the piston rings according to the present invention. To put it specifically, because the top rings 19 are the closest to the corresponding the combustion chamber than any other rings, the quantity of heat transmitted from the pistons 18 to the cylinder bores 12*a* through the top rings 19 becomes the largest. For this reason, the upper edge of the spacer 14 may be situated between the top rings 19 and the skirt parts 18*b* of the pistons 18, when the pistons 18 are situated in their maximum side-pressure generating positions, respectively. Moreover, the lower edge of the spacer 14 may be situated above the top rings 19, when the pistons 18 are situated in their bottom dead centers.

Further, it is desirable that the undersurfaces of the top portions 18*a* of the pistons 18 (the ceiling surfaces inside the pistons 18) should be situated above the upper edge of the spacer 14 when the pistons 18 are situated in their maximum side-pressure generating positions. In this way, the entire top portions 18*a*, whose thicknesses in the cylinder axis lines L2 direction are the largest in the pistons 18, can be exposed above the spacer 14. Accordingly, the top portions 18*a* of the pistons 18, which become high in temperature, can be effectively cooled.

What is claimed is:

1. A cooling structure for an internal combustion engine in which: a spacer is fitted inside a water jacket formed to surround a periphery of a plurality of cylinder bores of a cylinder block in the internal combustion engine, the spacer comprising a spacer main body part surrounding the cylinder bores, the spacer main body part being formed of a uniform height around all of the cylinder bores of the cylinder block in an axial direction of the cylinder bores; and a cooling condition of the cylinder bores is controlled by regulating a flow of cooling water in the water jacket by use of the spacer, wherein the spacer covers the cylinder bores entirely in a peripheral direction of the cylinder bores, and covers only an intermediate portion of the cylinder bores in a depth direction of the water jacket on both of an intake side and an exhaust side of the cylinder bores, and wherein the spacer is arranged closer to an inner wall surface of the water jacket than to an outer wall surface of the water jacket on both of the intake side and the exhaust side of the cylinder bores.

2. The cooling structure for an internal combustion engine according to claim 1, wherein the spacer main body part covers the cylinder bores entirely in the peripheral direction and comprises a lower support leg extending from the spacer main body part in a cylinder axis direction, having one end abutting against a bottom portion of the water jacket, and wherein the lower support leg is formed to have a smaller thickness in a radial direction than the spacer main body part.

3. A cooling structure for an internal combustion engine in which: a spacer is fitted inside a water jacket formed to surround a periphery of a plurality of cylinder bores of a cylinder block in the internal combustion engine, the spacer comprising a spacer body portion surrounding all of the cylinder bores of the cylinder block, the spacer body portion being formed of a uniform height in an axial direction of the cylinder bores; and a cooling condition of the cylinder bores is controlled by regulating a flow of cooling water in the water jacket by use of the spacer, wherein when a piston slidably fitted in at least one of the cylinder bores is situated in a maximum side-pressure generating position, an upper edge of the spacer is situated between a piston ring and a skirt part of the piston on both of an intake side and an exhaust side of the at least one cylinder bore.

4. The cooling structure for an internal combustion engine according to claim 3, wherein when the piston is situated in a bottom dead center, a lower edge of the spacer is situated above the piston ring on both of the intake side and the exhaust side of the at least one cylinder bore.

5. The cooling structure for an internal combustion engine according to claim 3 or 4, wherein the spacer is arranged along an inner wall surface of the water jacket.

6. The cooling structure for an internal combustion engine according to claim 1, wherein an urging device is provided on said spacer for urging portions of the spacer located on the intake side and the exhaust side of the cylinder bores to come closer to an inner wall surface of the water jacket.

* * * * *